US009746004B2

(12) United States Patent
Wamala

(10) Patent No.: US 9,746,004 B2
(45) Date of Patent: Aug. 29, 2017

(54) PULSE CONTROLLED LINEAR ACTUATOR

(71) Applicant: Dániel Alexander Wamala, Budapest (HU)

(72) Inventor: Dániel Alexander Wamala, Budapest (HU)

( * ) Notice: Subject to any disclaimer, the term of this patent is extended or adjusted under 35 U.S.C. 154(b) by 422 days.

(21) Appl. No.: 14/412,897

(22) PCT Filed: Jul. 19, 2013

(86) PCT No.: PCT/HU2013/000072
§ 371 (c)(1),
(2) Date: Jan. 5, 2015

(87) PCT Pub. No.: WO2014/013282
PCT Pub. Date: Jan. 23, 2014

(65) Prior Publication Data

US 2015/0159679 A1 Jun. 11, 2015

(30) Foreign Application Priority Data

Jul. 19, 2012 (HU) ..... 1200429

(51) Int. Cl.
*F15B 11/04* (2006.01)
*F04B 17/04* (2006.01)
(Continued)

(52) U.S. Cl.
CPC ..... *F15B 11/04* (2013.01); *F04B 7/0076* (2013.01); *F04B 17/04* (2013.01); *F04B 17/044* (2013.01);
(Continued)

(58) Field of Classification Search
CPC ..... F04B 7/0076; F04B 17/04; F04B 17/044; F04B 35/004; F04B 35/045;
(Continued)

(56) References Cited

U.S. PATENT DOCUMENTS 5,203,172 A 4/1993 Simpson et al.
8,011,903 B2 * 9/2011 Pollack ..... F04B 17/044 310/15
2011/0043309 A1 2/2011 Wamala et al.

FOREIGN PATENT DOCUMENTS

DE 104704 8/1898
DE 3104704 A1 8/1982
(Continued)

OTHER PUBLICATIONS

International Search Report issued in PCT/HU2013/000072, mailed on Dec. 5, 2013.

*Primary Examiner* — Logan Kraft
(74) *Attorney, Agent, or Firm* — Birch, Stewart, Kolasch & Birch, LLP

(57) ABSTRACT

Pulse controlled linear actuator comprising a working cylinder (9) for receiving a medium introduced through a valve system by a compressor/pump, a piston, the shank (13) of which represents the output of the actuator. It also comprises a central solenoid (1) and alternately moved iron cores (3). The central solenoid (1) and the iron cores (3) are arranged between upper and lower solenoids (2). The iron cores (3) have two separate medium spaces (14, 15). The first medium space (14) leads into the portion of the working cylinder (9) above the piston (10) and under the piston (10). The second medium space (15) is separated from the space between the iron cores (3) by the iron cores (3) and leads into the portion of the working cylinder (9) above the piston (10) and under the piston (10). The valves (4, 8) are counter-phase or phase pulse controlled.

7 Claims, 1 Drawing Sheet

Figure 1:
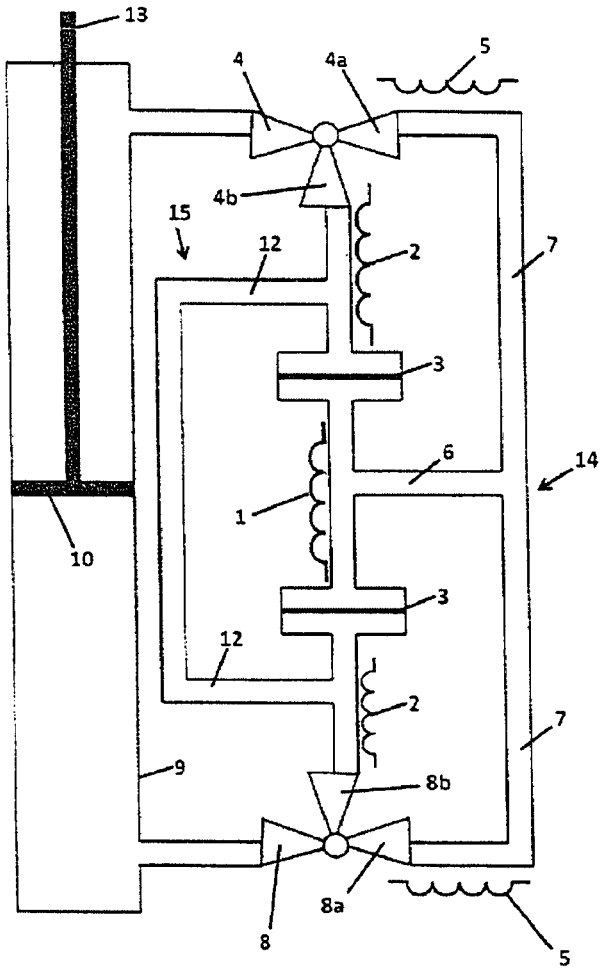

(51) Int. Cl.

| | |
|---|---|
| ***F04B 35/04*** | (2006.01) |
| ***F04B 7/00*** | (2006.01) |
| ***F15B 7/08*** | (2006.01) |
| ***F15B 15/18*** | (2006.01) |
| ***F15B 11/08*** | (2006.01) |

(52) U.S. Cl.
CPC ..... *F04B 35/045* (2013.01); *F15B 7/08* (2013.01); *F15B 11/08* (2013.01); *F15B 15/18* (2013.01); *F04B 2203/0403* (2013.01); *F15B 2211/20* (2013.01); *F15B 2211/20561* (2013.01); *F15B 2211/20576* (2013.01); *F15B 2211/3057* (2013.01); *F15B 2211/328* (2013.01)

(58) Field of Classification Search
CPC .... F04B 2203/0403; F15B 7/08; F15B 11/04; F15B 11/08; F15B 15/18; F15B 2211/20; F15B 2211/20561; F15B 2211/20576; F15B 2211/3057; F15B 2211/328; H02K 7/1884; H02K 33/12
IPC ..... H02K 7/1884,33/12
See application file for complete search history.

(56) References Cited

FOREIGN PATENT DOCUMENTS

| | | | | |
|---|---|---|---|---|
| GB | 1 496 147 | | 12/1977 | |
| HU | 226 838 | B1 | 12/2009 | |
| RU | 94043328 | A1 | 6/1996 | |
| WO | WO 2007029009 | A1 * | 3/2007 | ..... F15B 9/09 |

* cited by examiner

PULSE CONTROLLED LINEAR ACTUATOR

The invention relates to a pulse controlled linear actuator comprising a working cylinder for receiving a medium introduced through a valve system by a compressor/pump, in the working cylinder a piston is installed moving freely, and the piston shank represents the output of the actuator.

There are known actuators which transmit motion in a predetermined direction. Patent application HU226838 describes a solution suitable for installing small-sized actuators for a number of different purposes. However, there is a need for actuators of the similar kind, which can guarantee a long operational distance, while having a suitable compact structure.

The aim of the present invention is to provide a compact linear actuator according to the above.

With the solution of the present invention a linear actuator as described in the preamble is provided, which further comprises a central solenoid and positioned at least above and under the central solenoid upper and lower iron cores are arranged in pairs which are moved alternately by means of the central solenoid and by means of upper and lower solenoids arranged in pairs. The central solenoid and the iron cores are arranged between the upper and the lower solenoids, the iron cores form a compressor/pump having two separate medium spaces, from the space being between the upper and lower iron cores, the first medium space is led through a first inlet of an upper controlled dual inlet valve into the portion of the working cylinder which is above the piston, and in addition, it is led through a first inlet of a lower controlled dual inlet valve into the portion of the working cylinder which is under the piston; the second medium space is separated from the space being between the upper and lower iron cores by the iron cores, and is led through the second inlet of the upper controlled dual inlet valve into the portion of the working cylinder which is above the piston, and in addition, it is led through the second inlet of the lower controlled dual inlet valve into the portion of the working cylinder which is under the piston; and the upper and lower controlled valves are counter-phase or phase pulse controlled.

Figure 2:
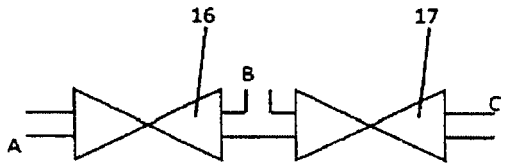

The embodiment of the present invention will be described with reference to the accompanying drawings in which:

FIG. 1 shows a block diagram of the embodiment according to the invention; and FIG. 2 shows an equivalent arrangement of the valves.

In the embodiment according to FIG. 1 a central solenoid 1 and a pair of solenoids 2 namely an upper and a lower solenoid 2 are arranged around a pair of iron cores 3. That is, around the central solenoid 1 positioned at least above and under it, upper and lower iron cores 3 are arranged in pairs. These are moved alternately by means of the central solenoid 1 and the upper and lower solenoids 2. Central solenoid 1 and iron cores 3 are arranged between upper and lower solenoids 2. Iron cores 3 form a compressor/pump having two separate medium spaces 14, 15. From the space being between the upper and lower iron cores 3, the first medium space 14 is led through a first inlet 4*a* of an upper controlled dual inlet valve 4 into the portion of the working cylinder 9, which is above the piston 10 provided with a piston shank 13, and it is also led through a first inlet 8*a* of a lower controlled dual inlet valve 8 into the portion of the working cylinder 9 which is under the piston 10. The second medium space 15 is separated from the space between the upper and lower iron cores 3 by the iron cores 3, and is led through the second inlet 4*b* of the upper controlled dual inlet valve 4 into the portion of the working cylinder 9, which is above the piston 10. In addition it is led through the second inlet 8*b* of the lower controlled dual inlet valve 8 into the portion of the working cylinder 9 which is under the piston 10. The upper and lower controlled valves 4, 8 are counter-phase or phase pulse controlled.

According to FIG. 1, medium spaces 14, 15 are formed from conduit 6 and pipe 7 as well as pair of conduits 12. However, other configurations are also feasible. Medium spaces 14, 15 may be realized in any other geometrical formation.

In the example of FIG. 1, when force is exerted, the respective ends of pipes 7 connect to valves 4, 8 through first inlets 4*a*, 8*a*.

In the initial state, medium space 14 is closed at the lower end with regard to pipe 7, while it is open at the upper end in the direction of the working cylinder 9 due to the positions of valves 4, 8.

In the initial state medium space 15 is open at the lower end with regard to conduit 12, while it is closed at the upper end from the direction of the working cylinder 9 due to the positions of valves 4, 8.

Iron cores 3 are in its furthest positions from the central solenoid 1.

All the solenoids are shut off.

At first step a PWM pulse drives solenoid 1 and solenoids 5.

As a result of the PWM pulse of the central solenoid 1, iron cores 3 move towards solenoid 1. During this movement, valves 4, 8 stay in position, because of the PWM pulses of solenoids 5.

Consequently the driving medium flows through conduit 6 into pipe 7. The fluid from the upper valve 4 flows into working cylinder 9 and exerts downward force—which is proportional to the forces applied on iron cores 3—on piston 10 in working cylinder 9, causing piston 10 to move downward.

Moving of piston 10 makes the medium also move downward. The medium flows into valve 8 which is open at the bottom and closed at the top with regard to medium space 15. Then it flows freely towards medium space 15, into the pair of conduits 12 leading into the expansion space of iron cores 3. Iron cores 3 are then moving away from solenoids 2, which are in switched off state.

In this manner the medium space 14 gets closed and movement will continue till iron cores 3 reach central solenoid 1.

Then the PWM pulse of the central solenoid 1 comes to an end and solenoids 2 are switched on. At the same time solenoids 5 are switched off, resulting in the opening of valve 4 at its second inlet 4*b*, and valve 8 gets closed at its second inlet 8*b*. Thus iron cores 3 move towards solenoids 2.

As a result of this, the driving medium flows into the pair of conduits 12. The ends of conduits 12 lead into respective valves 4, 8 which are in the state described earlier. The fluid from the upper valve 4 flows into working cylinder 9 and exerts downward force—which is proportional to the forces applied on iron cores 3—on piston 10 causing piston 10 to move downward. Moving of piston 10 makes the medium also move downward. The medium flows into valve 8 which are open at the bottom and closed at the top in the direction of pipe 7. From here it flows freely towards pipe 7, and then into conduit 6, through which it finally enters into the expansion space of iron cores 3. Iron cores 3 are then moving away from central solenoid 1, which is in switched off state. In this manner, the medium space 15 gets closed and movement will continue till iron cores 3 reach the pair of solenoids 2. Then the PWM pulse of the pair of solenoids 2 is switched off. The pair of solenoids 5 switches on again. Thus valve 8 opens from the side of its second inlet 8*b* and valve 4 closes from the side of its second inlet 4*b*. In this manner, the initial state is restored. In the initial state, medium space 14 is closed at the lower end, while it is open at the upper end with regard to pipe 7 in the direction of the working cylinder 9, due to the positions of valves 4, 8.

In alternative embodiments the medium may be liquid e.g. oil, water, etc. In other embodiments gaseous medium may be used e.g. air, nitrogen, etc. Ferrofluid may also be used as medium.

The material of the central solenoid 1 may be hard (permanent) magnet if the opposing magnetic elements—solenoids 2—are active (electromagnetic) or the iron cores 3 are electromagnetic or permanent magnets. Further, it may have a spring or gas spring mechanism.

The same design is also true for solenoids 2.

In the description of the present invention, the term iron cores 3 is used in a wide sense, they can be realized as elements containing ferrofluid. Iron cores 3 may be embodied by ferrofluid medium surrounded by membrane. The membrane e.g. may be made of plastic.

FIG. 2 shows an example for producing a controlled dual inlet valve according to valves 4, 8 from two serially coupled single inlet valves 16, 17. Inlets A and B ensure equivalent operation at outlet C. Single inlet valves 16, 17 are controlled in the same manner.

Piston shank 13 and working cylinder 9 may be curved or homocentric, in this case rotary motion can be ensured.

The invention claimed is:

1. Pulse controlled linear actuator comprising a working cylinder for receiving a medium introduced through a valve system by a compressor/pump, a piston moving freely in the working cylinder, the piston shank of the piston represents the output of the actuator characterized in that said actuator further comprises a central solenoid (1) and positioned at least above and under said central solenoid (1) upper and lower iron cores (3) are arranged in pairs which are moved alternately by means of said central solenoid (1) and by means of upper and lower solenoids (2) which are arranged in pairs, said central solenoid (1) and said iron cores (3) are arranged between said upper and lower solenoids (2), said iron cores (3) form the compressor/pump having two separate medium spaces (14, 15), from the space being between said upper and lower iron cores (3) said first medium space (14) is led through a first inlet (4*a*) of an upper controlled dual inlet valve (4) into the portion of said working cylinder (9) which is above said piston (10), and in addition it is led through a first inlet (8*a*) of a lower controlled dual inlet valve (8) into the portion of said working cylinder (9) which is under said piston (10); the second medium space (15) is separated from the space being between said upper and lower iron cores (3) by said iron cores (3), and is led through a second inlet (4*b*) of said upper controlled dual inlet valve (4) into the portion of said working cylinder (9) which is above said piston (10), and in addition it is led through the second inlet (8*b*) of said lower controlled dual inlet valve (8) into the portion of said working cylinder (9) which is under said piston (10); and said upper and lower controlled valves (4, 8) are counter-phase or phase pulse controlled.

2. Actuator according to claim 1 characterized in that said medium is liquid.

3. Actuator according to claim 1 characterized in that said medium is gas.

4. Actuator according to claim 1 characterized in that said upper and lower controlled valves (4, 8) are also provided with iron cores which are moved alternately by said upper and lower solenoids (2, 5).

5. Actuator according to claim 1 characterized in that it comprises a plurality of compressor/pump blocks each having at least a central solenoid (1) a pair of iron cores (3) and a pair of solenoids (2).

6. Actuator according to claim 1 characterized in that said iron cores (3) are formed from ferrofluid medium surrounded by membrane.

7. Actuator according to claim 1 characterized in that said upper and lower controlled dual inlet valves (4, 8) are formed from two serially coupled single inlet valves (16, 17).

* * * * *